US005824938A

United States Patent [19]

Costello et al.

[11] Patent Number: 5,824,938

[45] Date of Patent: Oct. 20, 1998

[54] VELOCITY SENSING TRIGGER INTERFACE FOR MUSICAL INSTRUMENT

[75] Inventors: Thomas M. Costello, Havertown; Gary M. Trapuzzano, Norristown; Carl V. Bader, Dowingtown, all of Pa.

[73] Assignee: Ensoniq Corporation, Malvern, Pa.

[21] Appl. No.: 954,783

[22] Filed: Oct. 21, 1997

[51] Int. Cl.[6] ..... G10H 1/18; G10H 1/34; G10H 1/32

[52] U.S. Cl. ..... 84/687; 84/615; 84/617; 84/653; 84/18; 84/20; 84/DIG. 7; 84/DIG. 12

[58] Field of Search ..... 84/615–620, 653–658, 84/682, 687–690, 738, 18, 20, 115, 411 P, DIG. 7, DIG. 12, DIG. 24

[56] References Cited

U.S. PATENT DOCUMENTS

| | | | |
|---|---|---|---|
| 3,890,871 | 6/1975 | Oberheim | 84/1.01 |
| 4,226,155 | 10/1980 | Ferdinand | 84/1.03 |
| 4,305,319 | 12/1981 | Linn | 84/1.01 |
| 4,418,598 | 12/1983 | Klynas | 84/1.03 |
| 4,479,412 | 10/1984 | Klynas | 84/1.04 |
| 4,500,756 | 2/1985 | Feagans et al. | 200/5 A |
| 4,674,384 | 6/1987 | Sakurai | 84/1.03 |
| 4,757,736 | 7/1988 | Tajima et al. | 84/1.03 |
| 4,781,097 | 11/1988 | Uchiyama et al. | 84/1.13 |
| 4,972,755 | 11/1990 | Tajima et al. | 84/667 |
| 4,995,294 | 2/1991 | Kashio et al. | 84/738 |
| 5,009,146 | 4/1991 | Manabe et al. | 84/615 |
| 5,157,213 | 10/1992 | Kashio et al. | 84/622 |
| 5,241,128 | 8/1993 | Imaizumi et al. | 84/618 |
| 5,350,881 | 9/1994 | Kashio et al. | 84/622 |

*Primary Examiner*—John W. Cabeca
*Assistant Examiner*—Marlon T. Fletcher
*Attorney, Agent, or Firm*—Woodcock Washburn Kurtz Mackiewicz & Norris LLP

[57] ABSTRACT

An electronic instrument which generates sound using a sound generator upon receipt of a trigger signal. Each pad actuator for generating a trigger signal includes first and second actuators for respectively triggering first and second switches which, upon actuation, generate the trigger signal for the sound generator. The pad actuator is mounted so as to rotate in a first direction about a pivot point upon depression by a user. The first actuator is placed closer to the pivot point than the second actuator and is mounted on a floating cantilever beam such that continued depression of the pad actuator in the first direction after actuation of the first switch by the first actuator causes the first actuator to displace in a second direction opposite the first direction while the second actuator continues to rotate in the first direction about the pivot point until the second switch is actuated by the second actuator. By using conventional circuitry to scan the first and second switches to determine the times of actuation of each, and a processor for processing the times to determine a velocity of depression of the pad actuator by the user, improved velocity profiles may be generated. The action of the cantilever beam also improves the "feel" of the interface to the user.

20 Claims, 9 Drawing Sheets

VELOCITY SENSING TRIGGER INTERFACE FOR MUSICAL INSTRUMENT

FIELD OF THE INVENTION

The present invention relates to a velocity sensing trigger interface for musical instruments, and more particularly, to a velocity sensitive drum or key pad interface with a cantilever beam mechanism which permits the switch actuators of the trigger interface to be separated by a distance which increases the velocity sensitivity.

BACKGROUND OF THE INVENTION

Musical instruments, such as electronic drums, electronic keyboards, keypad actuated sampling devices, and the like, have been used widely for several years. Conventionally, the musical instrument includes a drum pad or keypad which is used to actuate a switch which, in turn, triggers the generation of a sound corresponding to that drum pad or keypad. More sophisticated musical instruments also sense the velocity of the depression of the drum pad or keypad by the musician and this velocity data is used to appropriately modify the timbre, amplitude, and other characteristics of the generated sound.

Several techniques have been used in the art to determine the velocity of depression of the drum pad or keypad by the musician. For example, FIG. 1 is a schematic representation of a simple mechanical type of prior art velocity sensitive drum/key pad mechanism in which the drum/key pad 1 rotates about a pivot point 2 upon application of a depression force by the musician. A conductive wire 3 is connected between a flange 4 of the drum/key pad 1 and a stationary connection point 5 such that the conductive wire 3 contacts switch SW1 when the drum/key pad 1 is not depressed and contacts switch SW2 when the drum/key pad 1 is depressed. The velocity of depression of the drum/key pad 1 is determined by monitoring the time differential between the opening of SW1 and the closing of SW2.

FIG. 2 is a schematic representation of an integrated circuit type of prior art velocity sensitive drum/key pad mechanism. In this prior art design, the drum/key pad 1 similarly rotates about pivot point 2 upon application of a depression force by the musician. However, in this design, respective flanges 3 and 3' of the drum/key pad 1 have respective contacts 6 and 6' mounted thereon which close respective switches 7 and 7' on printed circuit board 8 as the drum/key pad 1 is depressed. Switch 7 closes before switch 7' since it is closer to the pivot point 2. The time of closure of the respective switches is determined by switch scanning circuitry and sent to a processing system via leads 9 for calculation of the time differential of switch closure, from which the velocity can be calculated. Unfortunately, because of the stiffness of the drum/key pad 1, the flanges 3 and 3' must be relatively close together to assure closure of switch 7' upon depression of drum/key pad 1. As a result, the measured time difference is not great, and the resulting velocity profile is greatly limited. On the other hand, if the stiffness of the drum/key pad 1 is modified, the drum/key pad 1 will no longer have a "feel" which is appealing to the musician.

Other types of velocity sensing trigger pad interfaces have also been developed in the art. For example, some electronic drums use force sensitive resistors placed beneath the drum pad to determine the force applied to the drum pad so that the generated sound can be appropriately modified. Piezoelectric elements also have been used for this purpose. However, such interfaces do not have parameter ranges which provide the desired sensitivity, and the resulting interfaces are typically too stiff to be appealing to the musician.

It is, accordingly, a primary object of the present invention to provide a trigger pad user interface for a musical instrument which improves the measured velocity profile for increased sensitivity.

It is a further object of the present invention to provide a trigger pad user interface for a musical instrument which improves the "feel" of the interface.

The present invention has been designed to meet these objects.

SUMMARY OF THE INVENTION

The above objects have been met in accordance with the present invention by providing a velocity sensing trigger drum pad or keyboard type user interface for a drum, sampler, keyboard instrument, and the like. As in the prior art, the basis for the velocity sensing is the reading of the time differential between two switch closures as the pad or key is depressed. The smaller the time differential, the faster the velocity and the greater the effect on the sound. Conversely, the larger the time differential, the slower the velocity and the lesser the effect on the sound. However, the invention is designed to improve the velocity sensitivity and "feel" of prior art velocity sensing trigger pad mechanisms.

In accordance with the invention, the two switch closures are formed as part of a switch matrix in a three layer flexible film membrane. The top and bottom layers have screen printed silver traces with black carbon over the contact area. The middle layer, on the other hand, is a spacer which keeps the switches open until an actuator on the pad or key applies a force on the top layer and brings the top layer into contact with the bottom layer, thereby closing the switch. Each "pad" or "key" used to actuate the switches includes two switch actuators, one for each switch.

The pad or key rotates around a first axis to close the first and second switches in succession. In accordance with a preferred embodiment of the invention, the first switch actuator is located on a cantilever beam which rotates about a second axis on the end of the pad remote from the first axis after the first switch is closed. The second switch actuator, on the other hand, is stationary and is located directly under the pad or key near the point of depression by the user.

When a user depresses the pad or key, the pad or key rotates about a roll pin or hinge (the first axis). The first switch actuator (on the cantilever beam) comes into contact with the flexible film membrane first switch and closes the first switch. At this point, the system hardware reads the time of the first switch's closure. As the pad or key continues to rotate, the cantilever beam rotates about the second axis in a direction opposite the overall pad or key rotation when depressed. This feature allows the pad or key to continue movement until the second switch actuator contacts the flexible film membrane second switch and closes the second switch. At this point, the system hardware reads the time of the second switch's closure and sends this information with the time of the first switch's closure to the system processor for calculation of the time differential and the associated velocity of depression of the pad or key.

Since the first switch actuator rotates with the cantilever beam in a direction opposite to the movement of the pad or key, the pad or key may be designed with a relatively large physical distance between the two switches. This increased distance provides the range required to provide a full velocity profile. The movement of the cantilever beam also allows the pad or key to have a more realistic, less rigid "feel" when depressed and to operate without breaking. The resulting velocity sensitive trigger pads are faster, more responsive, smoother, and more sensitive than comparable prior art devices.

BRIEF DESCRIPTION OF THE DRAWINGS

The present invention will be better understood after reading the following detailed description of the presently preferred embodiments thereof with reference to the appended drawings, in which.

DETAILED DESCRIPTION OF THE PRESENTLY PREFERRED EMBODIMENT

A drum/key pad mechanism which meets the above-mentioned objects and provides other beneficial features in accordance with the presently preferred exemplary embodiment of the invention will be described below with reference to FIGS. 3–11. Those skilled in the art will readily appreciate that the description given herein with respect to those figures is for explanatory purposes only and is not intended in any way to limit the scope of the invention. Accordingly, all questions regarding the scope of the invention should be resolved by referring to the appended claims.

Figure 1:
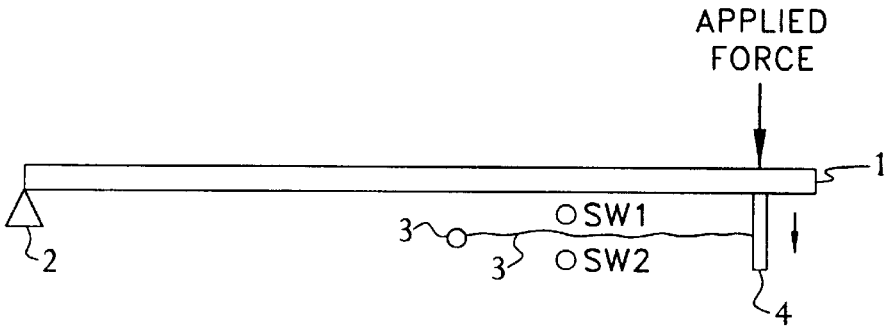
FIG. 1 PRIOR ART
FIG. 1 is a schematic representation of a first type of prior art velocity sensitive drum/key pad mechanism.
Figure 2:
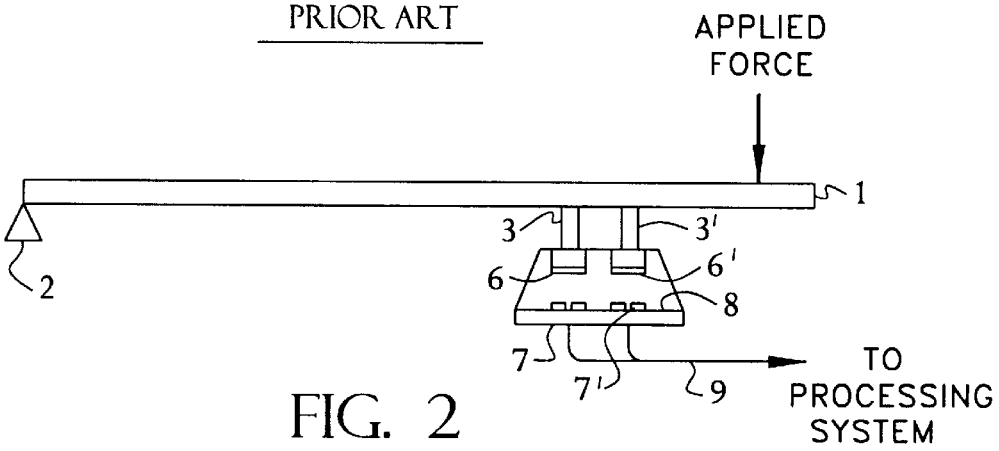
FIG. 2 PRIOR ART
FIG. 2 is a schematic representation of a second type of prior art velocity sensitive drum/key pad mechanism.
Figure 3:
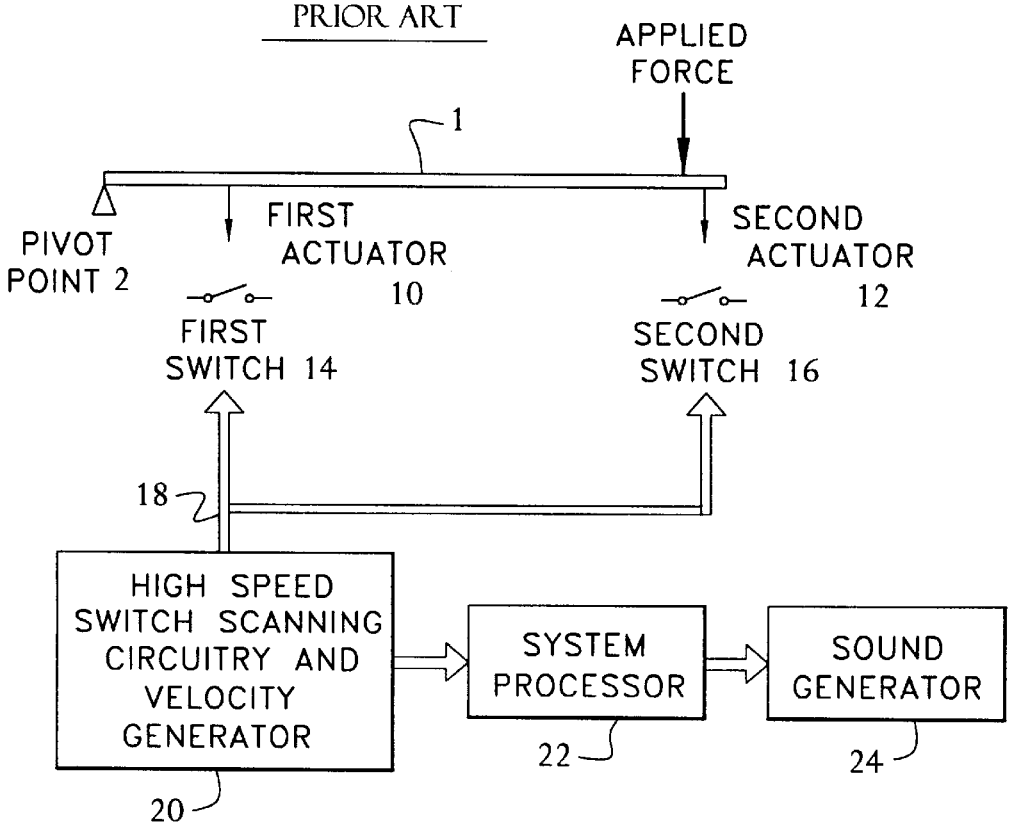
FIG. 3 is a simplified schematic representation of a velocity sensitive drum/key pad mechanism in accordance with the invention.

FIG. 3 is a simplified schematic representation of a velocity sensitive drum/key pad mechanism in accordance with the invention. As illustrated, drum/key pad 1 rotates about pivot point 2 upon application of a force by the operator or musician. A first actuator 10 on the drum/key pad 1 closes first switch 14, and some time later, second actuator 12 on the drum/key pad 1 closes the second switch 16. As will be explained in more detail below, first actuator 10 is mounted on the drum/key pad 1 such that as the drum/key pad 1 continues to rotate after closure of the first switch 14, the first actuator 10 rotates about a second axis in a direction opposite the overall drum/key pad rotation. The drum/key pad 1 then continues to rotate until the second actuator 12 closes second switch 16. The first and second switches are scanned over leads 18 by high speed switch scanning circuitry and velocity generator 20 approximately every 100 $\mu$s so that the time of closure of the respective switches can be determined. The time data is then sent to system processor 22 for calculation of the time differential of switch closure, from which the velocity is calculated. The resulting data is used to modify the trigger signals to sound generator 24 so that the timbre, amplitude, and other characteristics of the generated sound may be modified in a known fashion.

Figure 4:
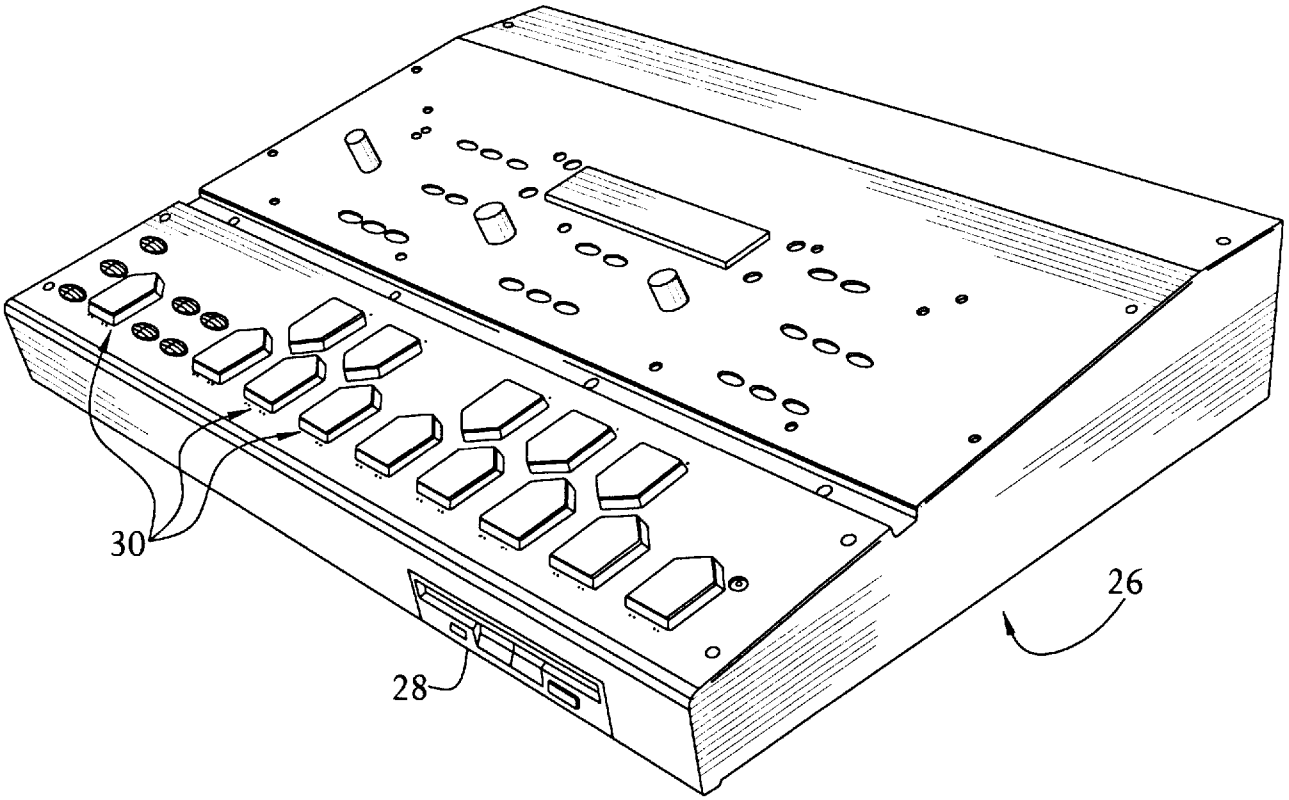
FIG. 4 illustrates a digital sampler musical instrument having a velocity sensitive drum/key pad mechanism in accordance with the invention.

FIG. 4 illustrates a digital sampler musical instrument 26 having a velocity sensitive drum/key pad mechanism in accordance with the invention. Of course, as noted above, the velocity sensitive drum/key pad mechanism of the invention may also be used in an electronic drum, an electronic keyboard, or any other device in which a determination of the velocity of pad depression is desired. During operation of the digital sampler of FIG. 4, digital sampler 26 receives musical data from a floppy disk inserted into port 28 and extracts samples of the stored sound which is then assigned to respective velocity sensitive drum pads 30 for playback. In other words, depression of drum pads 30 triggers playback of the sampled sound assigned to the respective drum pads 30.

Figure 5:
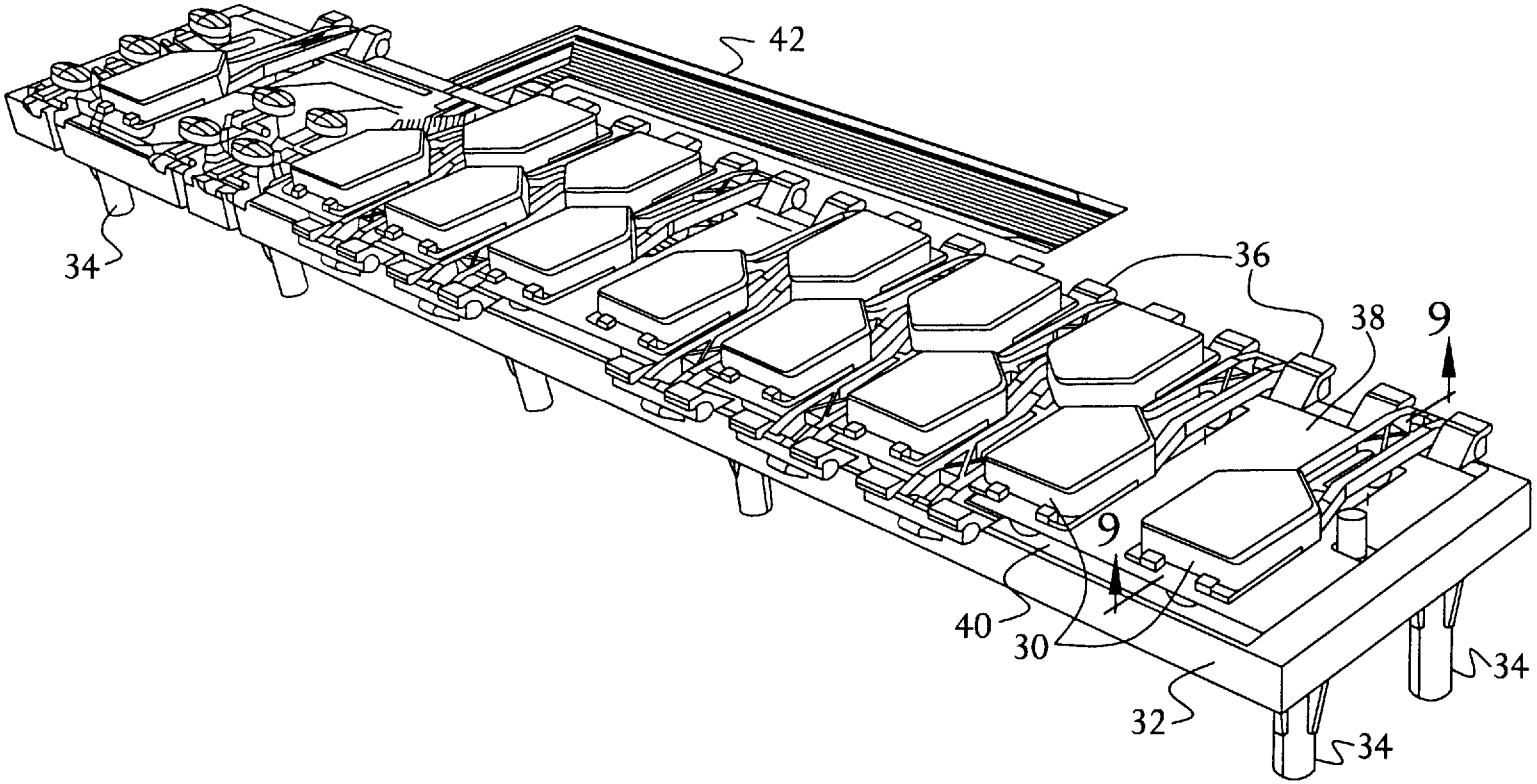
FIG. 5 illustrates the velocity sensitive drum/key pad mechanism in accordance with the invention after it has been removed from the digital sampler musical instrument of FIG. 4.
Figure 6:
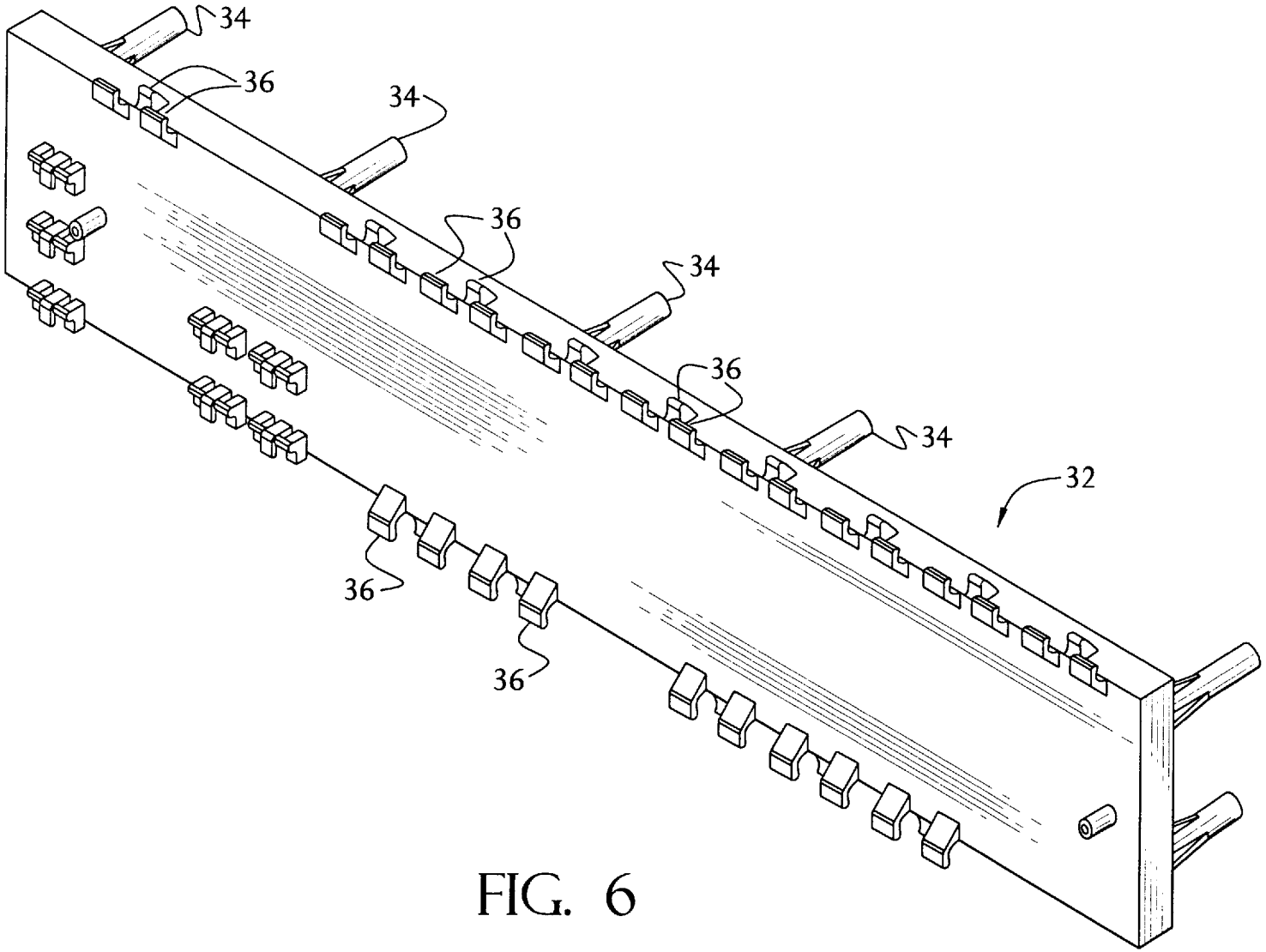
FIG. 6 illustrates the drum/key pad support structure of the velocity sensitive drum/key pad mechanism of FIG. 5.
Figure 7:
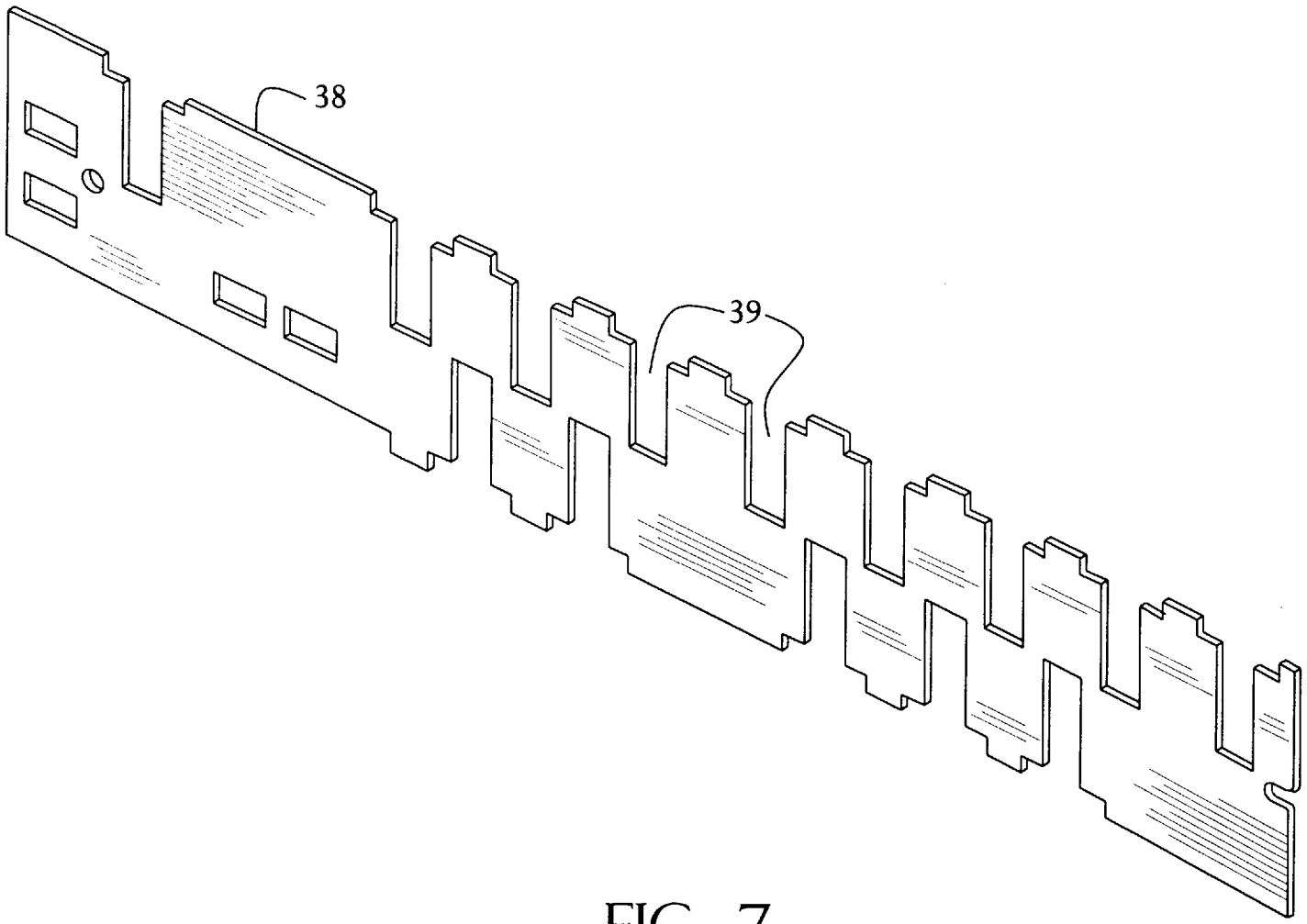
FIG. 7 illustrates the thin rubber barrier inserted between the drum/key pad and the film membrane including the switch matrix in order to dampen contact bouncing.

The velocity sensitive drum/key pad mechanism of the invention will be more fully appreciated by reference to FIG. 5, which illustrates the velocity sensitive drum/key pad mechanism in accordance with the invention after it has been removed from the digital sampler musical instrument 26 of FIG. 4. As illustrated, the drum/key pads 30 are mounted on a support structure 32 having legs 34 and a plurality of hinge receptacles 36 for accepting the hinges of a plurality of drum/key pads 30. Preferably, support structure 32, legs 34 and hinge receptacles 36 are formed of integral plastic as shown in FIG. 6. Between the drum/key pads 30 and support structure 32 is a thin rubber barrier 38 (FIG. 7) having cutouts 39 in the area where the first actuator 10 of the drum/key pad 30 comes into contact with the first switch 14. In a preferred embodiment, the first and second switches 14 and 16 are part of a switch matrix located in a three layer flexible film membrane 40 of the type described below with respect to FIG. 8. As illustrated in FIG. 5, thin rubber barrier 38 is preferably inserted between the drum/key pad 30 and the film membrane 40 in order to dampen contact bouncing and the physical noise of the impact on the drum/key pad 30. Leads 42 connect the trigger signals from the respective switches to high speed switch scanning circuitry 20 and system processor 22 for velocity calculation.

Figure 8:
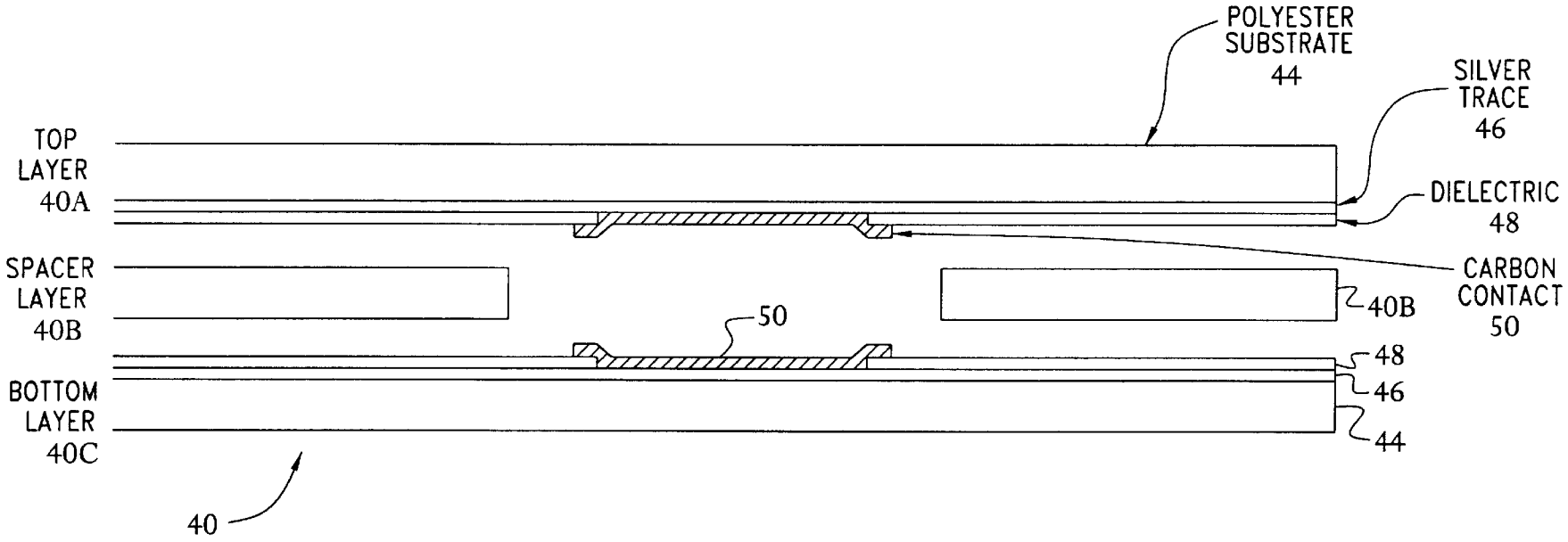
FIG. 8 illustrates a cross-section of the three layer flexible film membrane including the switch matrix responsive to the key/drum pad actuators.

FIG. 8 illustrates a cross-section of the three layer flexible film membrane 40 including the switch matrix responsive to the key/drum pad actuators 10 and 12. As shown, the top layer 40A and bottom layer 40C respectively comprise polyester (Mylar®) substrates 44 having formed thereon screen printed silver traces 46 and dielectrics 48 with black carbon 50 displacing the dielectric 48 over the contact area for switches 14 and 16. The middle layer 40B is a polyester (Mylar®) spacer which keeps the carbon contacts 50 separated until an actuator on the drum/key pad 30 applies a force on the top layer 40A and brings the carbon contacts 50 into contact with each other, thereby closing the switch. As can be appreciated from FIG. 3, each drum/key pad 30 includes two switch actuators and two switches. Thus, the switches for the respective drum/key pads 30 form a switch matrix in the film membrane 40.

Figure 9:
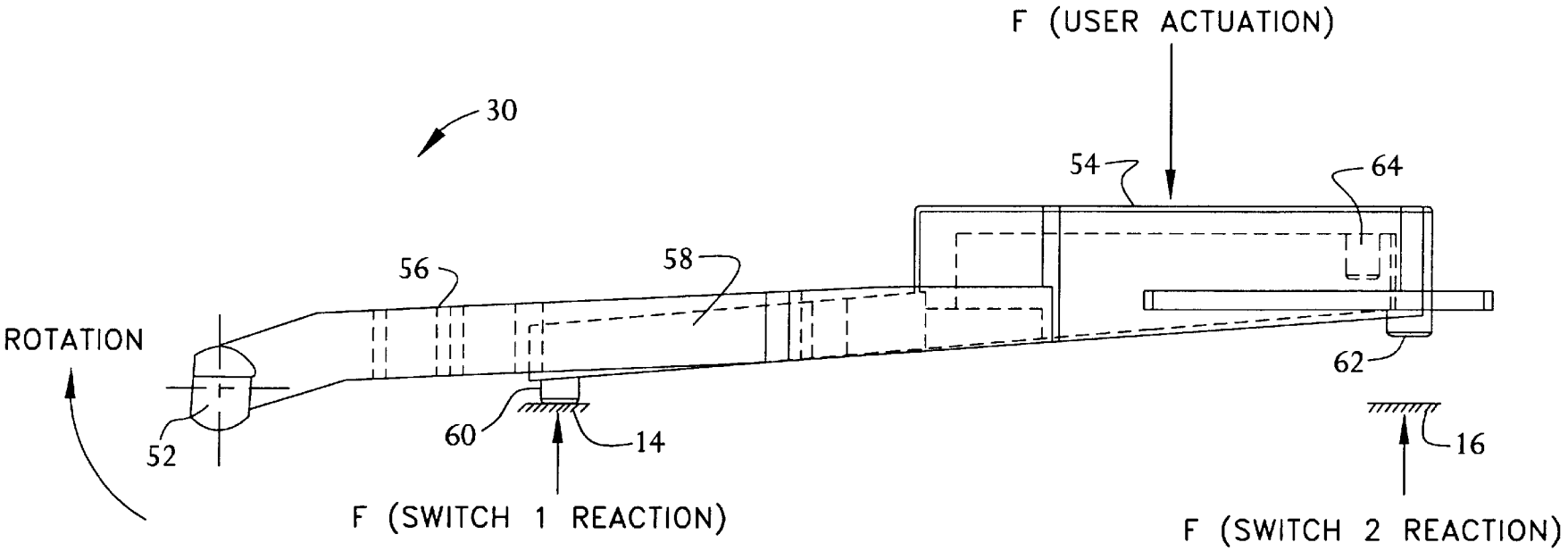
FIG. 9 illustrates a cross-section along line 9—9 of the drum/key pad of the velocity sensitive drum/key pad mechanism of FIG. 5.
Figure 10:
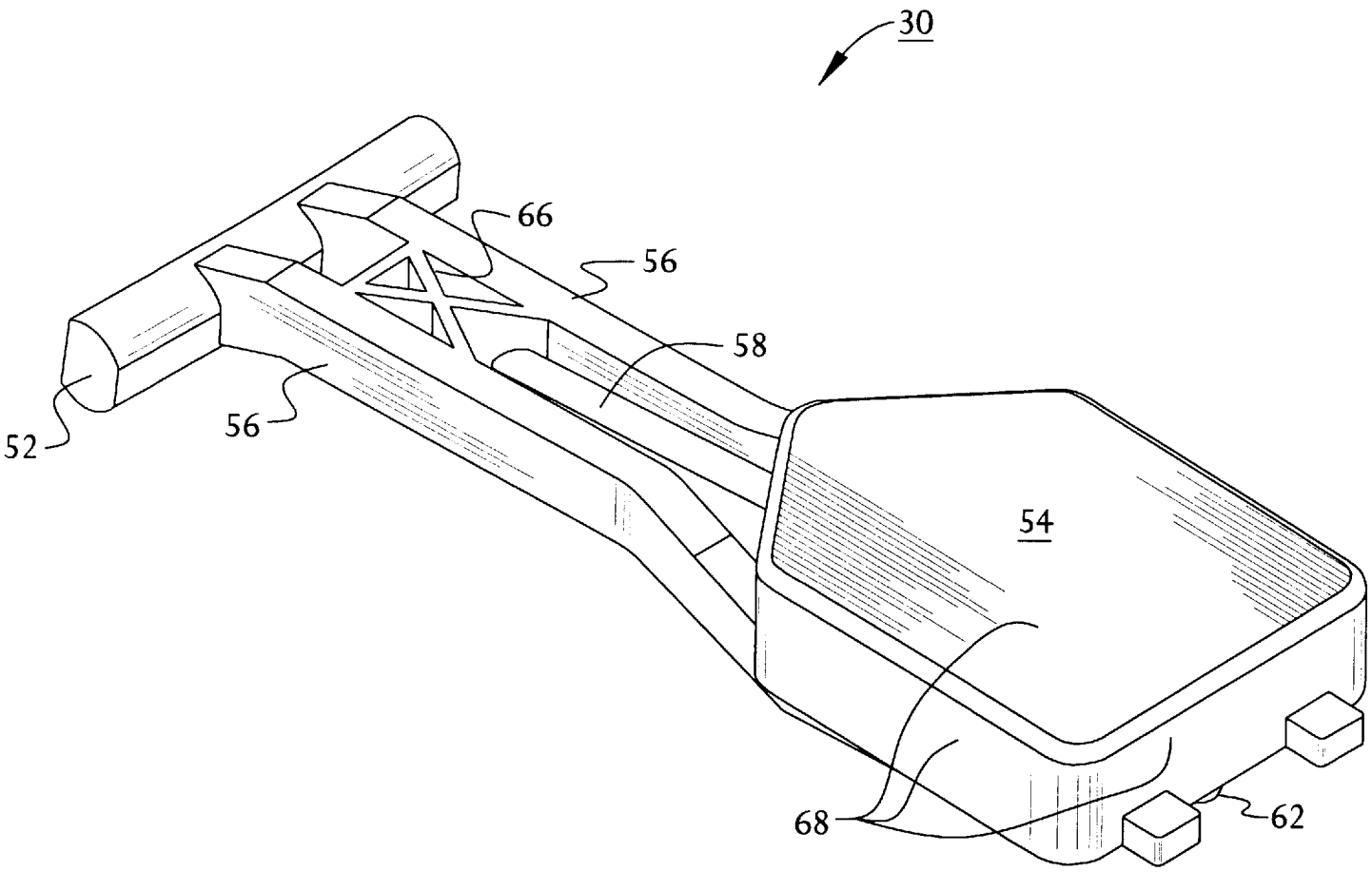
FIG. 10 illustrates a top perspective view of the drum/key pad actuator of FIG. 9.
Figure 11:
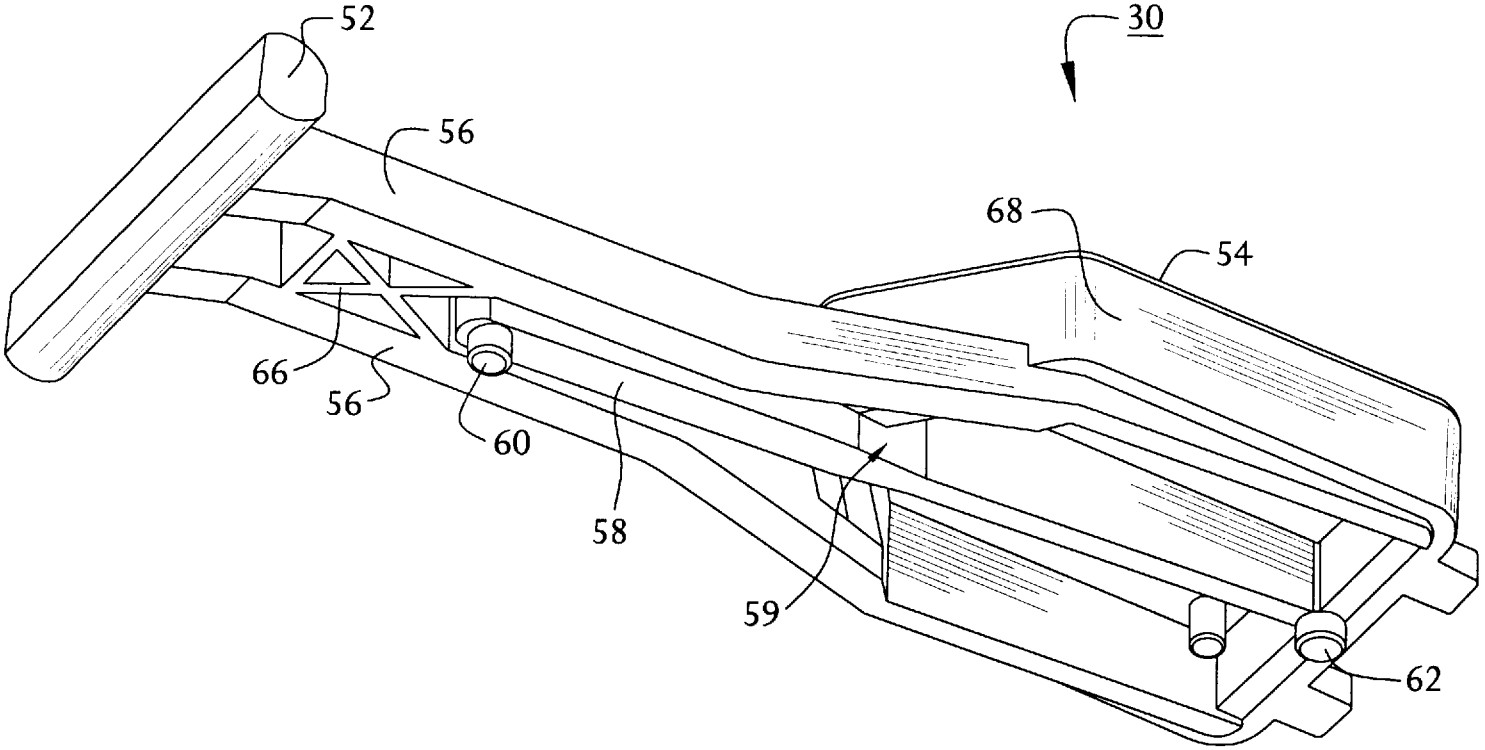
FIG. 11 illustrates a bottom perspective view of the drum/key pad actuator of FIG. 9.

FIG. 9 illustrates a cross-section along line 9—9 of the drum/key pad 30 of FIG. 5. As shown, drum/key pad 30 includes a roll pin or hinge 52 about which the drum/key pad 30 rotates when depressed on pad face 54 with a user actuation force F. Arms 56 (FIGS. 10 and 11) connect the roll pin or hinge 52 with the pad face 54. In accordance with a preferred embodiment of the invention, a floating beam or cantilever 58 extends from a pivot point 59 (FIG. 11) beneath the pad face 54 and includes a first contact 60 for the first switch 14. Second contact 62 for the second switch 16 is preferably fixed to the underside of pad face 54 as best illustrated in FIG. 11. Spring mounts 64 beneath pad face 54 accept springs (not shown) which provide the desired resiliency to drum/key pad 30. In a preferred embodiment, such springs are designed to have a spring rate of 0.40 lb/in and a length of 0.375 inches for a drum/key pad 30 designed to provide approximately 4 pounds of reaction force. As illustrated in FIG. 10, x-support 66 is preferably provided between arms 56 to provide structural support.

All drum/key pad structure described thus far with respect to FIGS. 9–11 may be cast from a resin such as Delrin 500M acetal as a single piece, although other resins with a sufficient modulus of elasticity, tensile strength, flexural modulus, and other material characteristics may also be used as desired. However, as shown in FIGS. 10 and 11, the drum/key pad 30 may also comprise an overlying layer 68 which is co-injection molded onto pad face 54 for providing a soft surface with the desired tactile feel to the user.

When depressed during operation, the drum/key pad 30 rotates about hinge 52 to close the first and second switches 14 and 16 in succession by impact of contacts 60 and 62, respectively. As illustrated in FIGS. 9–11, the first switch actuator including contact 60 is located on a cantilever beam 58 which rotates about axis 59 against the direction of rotation of the drum/key pad 30 after the first switch 14 is closed so that further rotation of the drum/key pad 30 is not limited. In particular, the first switch actuator including contact 60 comes into contact with the flexible film membrane first switch 14 and closes the first switch 14. At this point, the scanning circuitry 20 reads the time of closure of the first switch 14. As the drum/key pad 30 continues to rotate, the cantilever beam 58 rotates about the second axis 59 in a direction opposite the overall drum/key pad 30 rotation when depressed. This feature allows the drum/key pad to continue movement until the second switch actuator including contact 62 contacts the flexible film membrane second switch 16 and closes the second switch 16. At this point, the scanning circuitry 20 reads the time of closure of the second switch 16 and sends this information with the time of closure of the first switch 14 to the system processor 22 for calculation of the time differential and the associated velocity of depression of the drum/key pad 30.

Since the first switch actuator 60 rotates with the cantilever beam 58 in a direction opposite to the movement of the drum/key pad 30, the drum/key pad 30 may be designed with a relatively large physical distance between the two switches 14 and 16. This increased distance provides the range required to provide a full velocity profile. The movement of the cantilever beam 58 together with springs mounted on spring mount 64 also allow the drum/key pad 30 to have a more realistic, less rigid "feel" when depressed and operated without breaking. These elements also provide a rapid return to the non-actuated position to allow for rapid repetitions. The resulting velocity sensitive trigger pads have been found to be faster, more responsive, smoother, and more sensitive than comparable prior art devices.

It will be appreciated by those skilled in the art that the foregoing has set forth the presently preferred embodiment of the invention and an illustrative embodiment of the invention but that numerous alternative embodiments are possible without departing from the novel teachings of the invention. For example, those skilled in the art will appreciate that the techniques of the invention may be used with keys of electronic keyboards, with drum pad actuators for electronic drums and digital sampling instruments, and other pad triggered devices. Accordingly, all such modifications are intended to be included within the scope of the appended claims.

We claim:

1. An electronic instrument which creates trigger signals for triggering a sound generator, comprising:

first and second switches which, upon actuation, generate a trigger signal; and a pad actuator mounted to rotate in a first direction about a pivot point upon depression by a user, said pad actuator including a first actuator which actuates said first switch and a second actuator which actuates said second switch, said first actuator being closer to said pivot point than said second actuator and mounted such that continued depression of said pad actuator in said first direction after actuation of said first switch by said first actuator causes said first actuator to displace in a second direction opposite said first direction while said second actuator continues to rotate in said first direction about said pivot point until said second switch is actuated by said second actuator.

2. The instrument of claim 1, further comprising circuitry which scans said first and second switches to determine times of actuation of each, and a processor for processing said times to determine a velocity of depression of said pad actuator by said user for use by said sound generator in the generation of sounds triggered by said trigger signal which have appropriate timbre and amplitude characteristics.

3. The instrument of claim 1, wherein said pad actuator includes a cantilever beam upon which said first actuator is mounted, said cantilever beam rotating in said second direction about a pivot point at an end of said pad actuator proximate said second actuator.

4. The instrument of claim 1, wherein said first and second switches each comprise first and second substrate layers separated by a spacer layer, said first substrate layer including a first contact separated by said spacer layer from a second contact of said second substrate layer, whereby depression of one of said first and second substrate layers proximate its contact causes said first and second contacts to conduct with each other so as to form said trigger signal.

5. The instrument of claim 4, wherein said first and second substrate layers are formed of polyester.

6. The instrument of claim 1, wherein said second actuator is fixed on an end of said pad actuator opposite said pivot point.

7. The instrument of claim 1, wherein said sound generator generates sounds sampled from a musical medium or an acoustic source and said pad actuator is a drum pad which selects the sampled sound to be replayed.

8. The instrument of claim 1, wherein said sound generator generates drum sounds and said pad actuator is a drum pad.

9. The instrument of claim 1, wherein said sound generator generates keyboard sounds and said pad actuator is a key of a keyboard.

10. An electronic instrument which creates trigger signals for triggering a sound generator, comprising:

a plurality of pairs of first and second switches which pairs, upon actuation, generate respective trigger signals for said sound generator; and a pad actuator associated with each pair of first and second switches, each pad actuator being mounted to rotate in a first direction about a pivot point upon depression by a user, each pad actuator including a first actuator which actuates said first switch and a second actuator which actuates said second switch, said first actuator being closer to said pivot point than said second actuator and mounted such that continued depression of said pad actuator in said first direction after actuation of said first switch by said first actuator causes said first actuator to displace in a second direction opposite said first direction while said second actuator continues to rotate in said first direction about said pivot point until said second switch is actuated by said second actuator.

11. The instrument of claim 10, further comprising circuitry which scans each pair of said first and second switches to determine times of actuation of each pair of first and second switches, and a processor for processing said times to determine a velocity of depression of a pad actuator associated with each pair of said first and second switches by said user for use by said sound generator in the generation of sounds triggered by said trigger signals which have timbre and amplitude characteristics determined by the velocity of depression of said pad actuator associated with each said pair of first and second switches.

12. The instrument of claim 10, wherein each pad actuator includes a cantilever beam upon which said first actuator is mounted, said cantilever beam rotating in said second direction about a pivot point at an end of said pad actuator proximate said second actuator.

13. The instrument of claim 10, wherein each switch of said pairs of first and second switches comprises first and second substrate layers separated by a spacer layer, said first substrate layer including a first contact separated by said spacer layer from a second contact of said second substrate layer, whereby depression of one of said first and second substrate layers proximate its contact causes said first and second contacts to conduct with each other so as to form said trigger signals.

14. The instrument of claim 13, wherein said first and second substrate layers are formed of polyester.

15. The instrument of claim 10, wherein said second actuator is fixed on an end of said pad actuator opposite said pivot point.

16. The instrument of claim 10, wherein said sound generator generates sounds sampled from a musical medium or an acoustic source and said pad actuator is a drum pad which selects the sampled sound to be replayed.

17. The instrument of claim 10, wherein said sound generator generates drum sounds and each pad actuator is a drum pad.

18. The instrument of claim 10, wherein said sound generator generates keyboard sounds and each pad actuator is a key of a keyboard.

19. A user actuated pad interface which generates trigger signals for initiating operation of electronic circuitry, comprising:

first and second switches which, upon actuation, generate a trigger signal to said electronic circuitry; and a pad actuator mounted to rotate in a first direction about a pivot point upon depression by a user, said pad actuator including a first actuator which actuates said first switch and a second actuator which actuates said second switch, said first actuator being closer to said pivot point than said second actuator and mounted such that continued depression of said pad actuator in said first direction after actuation of said first switch by said first actuator causes said first actuator to displace in a second direction opposite said first direction while said second actuator continues to rotate in said first direction about said pivot point until said second switch is actuated by said second actuator.

20. The pad interface of claim 19, wherein said pad actuator includes a cantilever beam upon which said first actuator is mounted, said cantilever beam rotating in said second direction about a pivot point at an end of said pad actuator proximate said second actuator.

* * * * *